US007093461B2

(12) United States Patent
Patel et al.

(10) Patent No.: US 7,093,461 B2
(45) Date of Patent: Aug. 22, 2006

(54) RECEIVER-DRYER FOR IMPROVING REFRIGERATION CYCLE EFFICIENCY

(75) Inventors: Chhotu N. Patel, Phoenix, AZ (US); Paul Matthews Pickett, Jr., North Branch, MI (US)

(73) Assignee: Hutchinson FTS, Inc., Troy, MI (US)

( * ) Notice: Subject to any disclaimer, the term of this patent is extended or adjusted under 35 U.S.C. 154(b) by 47 days.

(21) Appl. No.: 10/801,889

(22) Filed: Mar. 16, 2004

(65) Prior Publication Data

US 2005/0204772 A1 Sep. 22, 2005

(51) Int. Cl.
*F25B 43/00* (2006.01)

(52) U.S. Cl. ..... 62/512; 62/509

(58) Field of Classification Search ..... 62/509, 62/512

See application file for complete search history.

(56) References Cited

U.S. PATENT DOCUMENTS 4,072,615 A 2/1978 McConnell
4,628,704 A 12/1986 Kilby
4,694,662 A 9/1987 Adams
5,159,821 A 11/1992 Nakamura
5,224,358 A 7/1993 Yamanaka et al.
5,228,315 A 7/1993 Nagasaka et al.
5,245,842 A 9/1993 Searfoss et al.
5,331,827 A 7/1994 Chlebak
5,375,327 A 12/1994 Searfoss et al.
5,394,710 A 3/1995 Matsuo et al.
5,546,761 A 8/1996 Matsuo et al.
5,580,451 A 12/1996 Tack
5,685,364 A 11/1997 Harris
5,709,106 A * 1/1998 Inaba et al. ..... 62/507
5,713,217 A 2/1998 Baba
5,724,830 A 3/1998 Otis et al.
5,868,002 A 2/1999 Matsubayashi
5,894,884 A 4/1999 Durian et al.
5,901,573 A 5/1999 Kobayashi
5,927,102 A 7/1999 Matsuo et al.
5,934,102 A 8/1999 DeKeuster et al.
5,937,671 A 8/1999 Inoue et al.
5,946,938 A 9/1999 Balthazard
5,946,940 A 9/1999 Inoue
5,974,828 A 11/1999 Guerand
6,038,884 A 3/2000 Dabrowski
6,041,618 A 3/2000 Patel et al.
6,470,704 B1 * 10/2002 Shibata et al. ..... 62/509
6,477,858 B1 11/2002 Nobuta et al.

* cited by examiner

*Primary Examiner*—Cheryl Tyler
*Assistant Examiner*—B. Clayton McCraw
(74) *Attorney, Agent, or Firm*—VanOphem & VanOphem, P.C.

(57) ABSTRACT

A receiver-dryer of an integrated receiver-dryer-condenser for an air-conditioning system that maximizes a liquid phase of refrigerant therein for return to a sub-cooling stage of a condenser. A receiver-dryer vessel includes a base wall, a side wall extending from the base wall, and a concave end wall terminating the side wall. A refrigerant inlet pipe extends into the interior of the vessel and terminates in an exit end that faces the concave end wall of the vessel. The refrigerant inlet pipe is adapted for directing refrigerant into contact with the concave end wall such that the refrigerant impinges on the concave end wall for improved dispersion into a gaseous phase that accumulates in the upper portion of the vessel and a liquid phase that flows down the walls of the vessel to accumulate in the lower portion of the vessel and for improved separation of the liquid phase and to return to the sub-cooling stage of the condenser for improved sub-cooling of the liquid phase of the refrigerant.

18 Claims, 6 Drawing Sheets

RECEIVER-DRYER FOR IMPROVING REFRIGERATION CYCLE EFFICIENCY

CROSS-REFERENCES TO RELATED APPLICATIONS

Not applicable.

FEDERALLY SPONSORED RESEARCH OR DEVELOPMENT

Not applicable.

REFERENCE TO A MICROFICHE APPENDIX

Not applicable.

BACKGROUND OF THE INVENTION

1. Field of the Invention

The present invention generally relates to automotive air conditioning systems. More specifically, this invention is directed to a receiver-dryer for use in an automotive air conditioning system wherein the receiver-dryer includes unique features for improving the efficiency of the separation of a gas phase from a liquid phase of a refrigerant fluid and for redirection of the liquid phase so as to improve sub-cooling of the refrigerant through the receiver-dryer and a condenser.

2. Description of the Related Art

Air-conditioning systems for motor vehicles are well known. FIG. 5 illustrates an example of a typical air-conditioning system 10, which essentially includes a compressor 12, a condenser 14, a thermal expansion valve 16, an evaporator 18, a refrigerant line 20 connecting the aforementioned components together, and a refrigerant fluid flowing therethrough (as represented by the various arrows). It is also known to provide a receiver-dryer 22 in a refrigeration circuit between the condenser 14 and the thermal expansion valve 16 to remove particulates and moisture from the refrigerant fluid and thereby protect the downstream components.

At the beginning of a refrigeration cycle, an upstream side 24 of the compressor 12 receives a gaseous phase of the refrigerant fluid. Powered by an engine of the motor vehicle (not shown) via a belt drive 26 and clutch 28 or electrically driven system, the compressor 12 compresses the refrigerant fluid to increase the temperature and pressure to create a superheated vapor and to pump the refrigerant downstream through the refrigerant line 20 to the condenser 14.

Within the condenser 14, the superheated refrigerant fluid changes from its gaseous phase to a mostly liquid phase. The superheated vapor of the refrigerant fluid flows through interior passages 30 of the condenser 14 while ambient air flows over exterior surfaces 32 and cooling fins 34 of the condenser 14. The superheated vapor is much hotter than the ambient air. Thus, the heat of the superheated vapor is given off to the surrounding ambient air flowing over the exterior surfaces 32 and cooling fins 34 of the condenser 14, thereby cooling the refrigerant fluid in accord with heat transfer principles. As the refrigerant fluid continues to flow through the condenser 14 and lose more heat to the surrounding ambient air, it begins to condense from its gaseous phase into a liquid phase. Eventually, the refrigerant fluid exits the condenser 14, mostly in a liquid phase (X) but typically including some gaseous portion, and flows downstream through the refrigerant line 21, and enters the receiver-dryer 22.

The receiver-dryer 22 includes an adsorbent unit 36 therein for dehydrating or removing water from the refrigerant fluid. The receiver-dryer 22 includes an outlet line 38 having a pickup end 40 disposed in a lower region 42 for communicating only liquid phase, and not gaseous phase, refrigerant out of the receiver-dryer 22 and downstream to the thermal expansion valve 16.

The thermal expansion valve 16 "expands" the refrigerant fluid so as to suddenly reduce the pressure of the refrigerant fluid. This sudden reduction in pressure causes the refrigerant fluid to be sprayed through the refrigerant line 20 downstream to the evaporator 18.

Within the evaporator 18, the evaporation process extracts the required evaporator heat from an incoming stream of fresh or recirculating interior air, thereby cooling the air. The now latent heat of liquid fluid phase of the refrigerant fluid changes back into a gaseous phase as a result of the heat received from the fresh or recirculating interior air. While the now relatively cool refrigerant fluid flows through interior passages (not shown) of the evaporator 18, relatively hot ambient air flows over exterior surfaces (not shown) of the evaporator 18, in similar fashion as the condenser 14. The evaporator 18 cools the hot moist ambient air because the humidity or water vapor in the hot ambient air collects or condenses on the exterior surfaces of the evaporator 18. The evaporator 18 also dehumidifies the hot moist ambient air because the moist ambient air is given off to the relatively cold refrigerant flowing through the evaporator 18, thereby warming the refrigerant fluid and cooling the air flowing over the exterior surfaces of the evaporator 18. Thus, a supply of cool, dry, dehumidified air flows away from the evaporator 18 and into a passenger compartment of the motor vehicle (not shown), while the heated gaseous refrigerant flows out of the interior passages of the evaporator 18, through the refrigerant line 20 downstream back to the compressor 12 where the refrigeration cycle repeats.

Referring to prior art FIGS. 5 and 6, there is shown a pressure vs. enthalpy diagram of the prior art refrigeration cycle with pressure depicted along the ordinate and enthalpy depicted along the abscissa. Schematic points O, A, D, and F of FIG. 5 are graphically represented in FIG. 6 as points O, A, D, and F of the refrigeration cycle. In general, path O–A represents the compression stage of the refrigeration cycle, path A–D represents the condensing stage, path D–F represents the expansion stage, and path F–O represents the evaporation stage of the refrigeration cycle. Point B represents the transition point at which the refrigerant condenses from a superheated vapor to a saturated vapor. Point C represents the transition point at which the refrigerant further condenses from a liquid-vapor mixture to a saturated liquid.

In prior art air-conditioning systems, under vehicle usage conditions there may—or may not—be sub-cooling at the output side (range X—in FIG. 6, B–C) of the condenser (14 in FIG. 5), depending upon the state of the refrigerant fluid due to various vehicle performance variables. In other words, and referring to FIG. 6, range X represents the variable nature of the refrigerant fluid temperature at the downstream or output side of the condenser 14 at range X in FIG. 5 and $Y_1$ represents the sub-cooling of prior art refrigeration cycle. Whereas point A is well defined and fixed at the location on the pressure vs. enthalpy diagram as shown, range X is not so well defined and varies along the condenser path A–D of the pressure vs. enthalpy diagram depending upon the vehicle performance variables of vehicle speed and load on the air-conditioning system. The slower the vehicle speed, or at idle condition and, the higher the load on the air-conditioning system, the sub-cooling range $Y_1$ diminishes and may approach zero. Under these conditions, the refrigeration cycle looses sub-cooling capability and operates only in the "X" range. Likewise, point D is dependent upon the amount of sub-cooling that can be performed on the refrigerant beyond point C. In other words, point D is incrementally dependent upon the cooling load and quantity of ambient air flow when the air conditioning system is properly charged with refrigerant.

Referring to FIG. 6, the amount of heat (Q) that can be removed by the condenser (14) is represented by the equation $Q=M_{R134a}*(h2-h1)$. $M_{R134a}$ is the variable mass flow for R134*a* refrigerant while h2 is the enthalpy at the beginning of the refrigerant entering into the condenser, 14 and h1 is the enthalpy at the receiver dryer outlet D. Assuming a constant mass flow, the greater the range in enthalpy that the air-conditioning system can produce, the greater the heat that can be removed.

More recent advancements in automotive refrigeration suggest structurally integrating a receiver-dryer with a condenser. For example, U.S. Pat. No. 5,927,102 to Matsuo et al. teaches a receiver that is integrally mounted to a condenser in such a manner as to maintain a constant sub-cool temperature. The '102 patent discloses the condenser as including a pair of opposed and vertically extending first and second header tanks and a core composed of a plurality of tubes extending between the header tanks in a generally horizontal fashion. At the top of the first header tank, an inlet joint is disposed into which superheated refrigerant from the compressor flows. At the bottom of the second header tank, an outlet joint is disposed out of which substantially condensed refrigerant flows. Inner spaces of the header tanks are divided by separators into an upper space into which the superheated refrigerant flows and a lower space into which flows refrigerant cooled down in the core. The receiver is mounted to the condenser in fluidic communication between the upper and lower spaces of the condenser. More specifically, the receiver-dryer is mounted to the condenser such that the receiver does not overlap with the upper space in order to minimize heat transfer from the incoming superheated refrigerant to the refrigerant fluid collected in the receiver, thereby minimizing evaporation of the refrigerant fluid. Accordingly, a "whole" space of the receiver can be reserved for adding make up refrigerant to compensate for loss of refrigerant due to leakage, while maintaining a constant sub-cool temperature.

From the above, it can be appreciated that receiver-dryers of the prior art are not fully optimized. For example, while the '102 patent does teach passive stabilization of the sub-cooling temperature of the condenser, it does not teach active optimization of sub-cooling of the condenser. In other words, the '102 patent focuses on passively avoiding evaporation of the liquid phase of the refrigerant fluid within the condenser, rather than actively maximizing condensing of the gas phase into the liquid phase. Moreover, the performance of the prior art receiver-dryer of FIGS. 5 and 6 is excessively dependent upon vehicle operating conditions and air conditioning demand. Thus, there remains a need for an integrated receiver-dryer that is less dependent upon vehicle operating conditions and air conditioning demand, and that not only minimizes evaporation of a liquid phase therein, but also maximizes the liquid phase so as to return relatively more liquid phase to the condenser for additional sub-cooling, thereby enabling the condenser to consistently output 100% sub-cooled liquid phase refrigerant.

BRIEF SUMMARY OF THE INVENTION

The present invention contemplates a receiver-dryer for use as part of an integrated receiver-dryer-condenser of an air-conditioning system of an automotive vehicle, wherein the receiver-dryer optimizes or maximizes a liquid phase of refrigerant therein so as to return relatively more separated liquid phase to a condenser for additional sub-cooling of the refrigerant.

According to the preferred embodiment of the present invention, there is provided a receiver-dryer including a substantially cylindrical vessel having an interior defined by a base wall, a side wall extending vertically upwardly from the base wall, and a concave end terminating the side wall and disposed substantially opposite of the base wall. A refrigerant inlet pipe extends into the interior of the vessel in a generally vertically upward direction and terminates in an exit end that faces the concave interior end of the vessel. The refrigerant inlet pipe is adapted for directing refrigerant as a liquid and gas mixture into contact with the concave end such that the refrigerant impinges on the concave end to disperse the refrigerant into a total gaseous phase that accumulates in the upper portion of the vessel and a liquid phase that runs down the interior surfaces of the concave end and side wall of the receiver-dryer for cooling and for accumulation in the lower portion of the vessel. A refrigerant outlet pipe is in fluidic communication with the interior of the vessel.

In another aspect of the present invention, an integrated receiver-dryer-condenser is adapted for use in air conditioning system, wherein the integrated receiver-dryer-condenser includes a condenser and a receiver-dryer fluidically connected to the condenser.

The condenser of the receiver-dryer-condenser includes a first vertically disposed header tank, a second vertically disposed header tank spaced substantially laterally opposite of the first vertically disposed header tank, and a core positioned between the first and second vertically disposed header tanks. The core includes a plurality of horizontally disposed passages in fluidic communication with the first and second vertically disposed header tanks for communicating refrigerant fluid therebetween. An inlet is disposed in one of the first and second vertically disposed header tanks and is adapted for receiving a superheated gaseous phase of the refrigerant fluid. An intermediate outlet port is disposed in one of the first and second vertically disposed header tanks and is adapted for exiting a mixture of a gaseous phase and a liquid phase of the refrigerant fluid. An intermediate inlet port is disposed in one of the first and second vertically disposed header tanks and is adapted for receiving a dispersed liquid phase of the refrigerant fluid. An outlet is disposed in one of the first and second vertically disposed header tanks and is adapted for exiting a sub-cooled liquid phase of the refrigerant fluid.

The receiver-dryer of the integrated receiver-dryer-condenser includes a substantially cylindrical vessel having an interior defined by a base wall, a side wall extending vertically upwardly from the base wall, and a concave end terminating the side wall. A refrigerant inlet pipe is disposed in fluidic communication with the intermediate port of the condenser, extends therefrom into the interior of the vessel in a generally vertically upward direction, and terminates in an exit end facing the concave end. The refrigerant inlet pipe is adapted for directing refrigerant into contact with the concave end such that the refrigerant impinges on the concave end to disperse the refrigerant into a gaseous phase that accumulates in the upper portion of the vessel and a liquid phase that runs down the interior surfaces of the concave end and side wall for heat transfer cooling and for accumulation in the lower portion of the vessel. A refrigerant outlet pipe is disposed in fluidic communication with the interior of the vessel and with the intermediate inlet port of the condenser.

In a further aspect of the present invention, a method is provided for sub-cooling refrigerant within an air conditioning system. The method includes receiving a superheated high pressure gaseous phase of a refrigerant fluid in a condensing stage of a condenser and condensing the superheated high pressure gaseous phase of the refrigerant fluid therein into a mixture of a gaseous phase and a liquid phase. The method further includes communicating the mixture into a vertically disposed vessel and directing the mixture into an upper concave surface of the vertically disposed vessel, thereby dispersing the liquid phase from the gaseous phase wherein the liquid phase falls toward a lower portion of the vessel over a desiccant material, and further thereby cooling the gas and liquid phases for improved sub-cooling of the liquid phase and for improved condensing of the gas phase into the liquid phase. Finally, the method includes communicating the now separated, cooled, and dehydrated liquid phase out of the vessel.

It is an object of the present invention to provide an improved receiver-dryer for use in an improved integrated receiver-dryer-condenser of an automotive air-conditioning system and to provide an improved method of sub-cooling refrigerant within an automotive air-conditioning system.

It is yet another object to provide an integrated receiver-dryer that is less dependent upon vehicle operating conditions and air conditioning demand placed on an automotive air-conditioning system, compared to prior art receiver-dryer designs.

It is a further object to provide a receiver-dryer that is capable of not only minimizing evaporation of a liquid phase of refrigerant therein, but is also capable of maximizing the liquid phase therein so as to return relatively more liquid phase to a condenser for additional sub-cooling.

It is still a further object to provide an integrated receiver-dryer-condenser that outputs 100% sub-cooled liquid phase refrigerant fluid.

It is yet a further object to provide a more simplified and cost effective integrated receiver-dryer-condenser that is at least as efficient as prior art designs.

These objects and other features, aspects, and advantages of this invention will be more apparent after a reading of the following detailed description, appended claims, and accompanying drawings.

DETAILED DESCRIPTION OF THE PREFERRED EMBODIMENT

Figure 1:
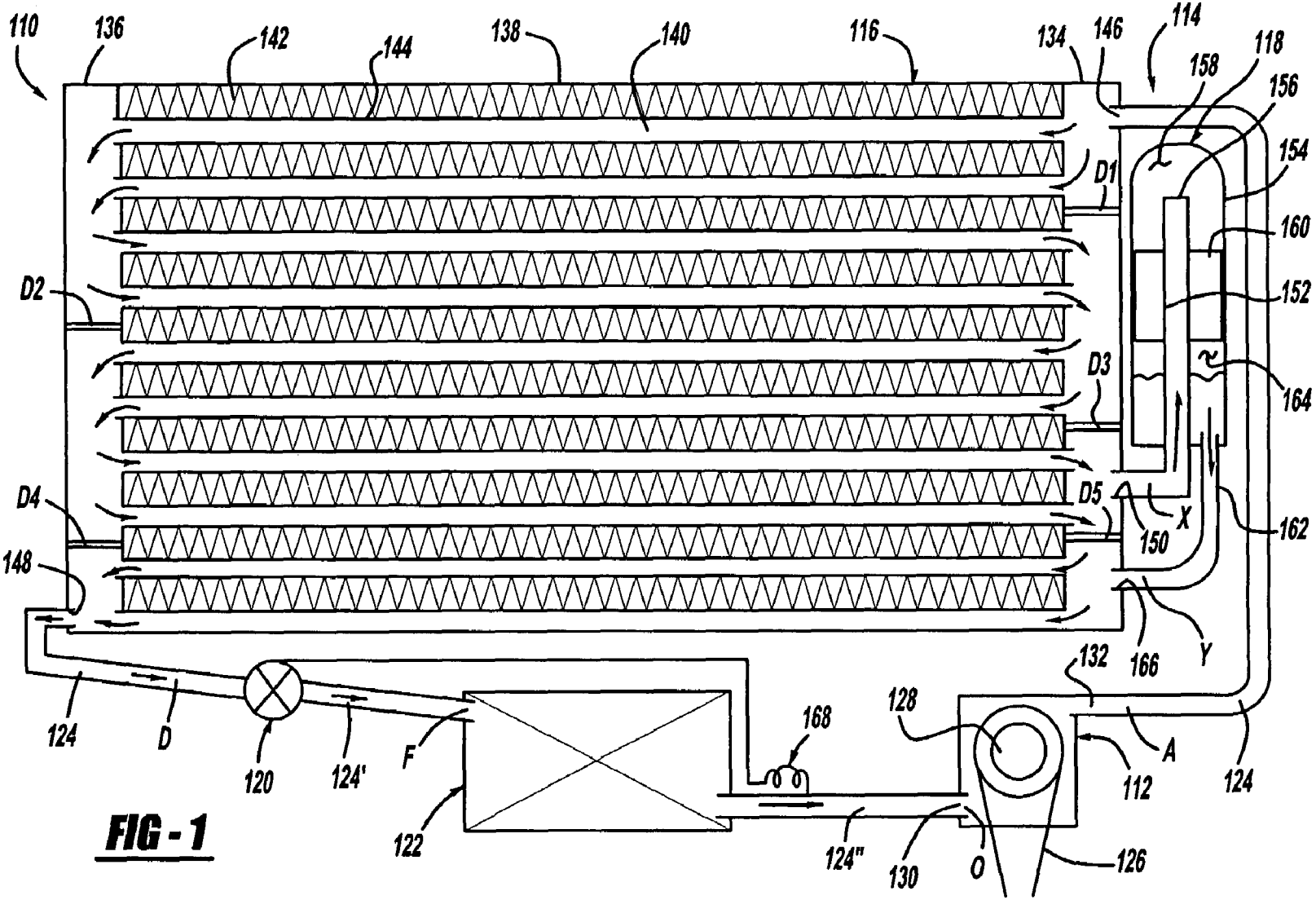
FIG. 1 is a schematic view of a refrigeration system according to an embodiment of the present invention, illustrating a condenser and a receiver-dryer according to an embodiment of the present invention.

Generally shown in the Figures, an integrated receiver-dryer-condenser is provided within a refrigeration system in accordance with an embodiment of the present invention for improved refrigerant sub-cooling and refrigeration cycle efficiency. A receiver-dryer of the integrated receiver-dryer-condenser is designed to optimize or maximize a liquid phase of refrigerant therein so as to return relatively more liquid phase to a condenser of the integrated receiver-dryer-condenser for additional sub-cooling.

Referring now in detail to the Figures, there is shown in FIG. 1*a* refrigeration system 110, which operates in accordance with a method of the present invention. The refrigeration system 110 generally includes the following components: a compressor 112 for compressing and pumping refrigerant through the condenser 116; an integrated receiver-dryer-condenser (IRDC) 114 having, mechanically attached, a condenser 116 for condensing the refrigerant into liquid, and a receiver-dryer 118 for separating and cooling the refrigerant; a thermal expansion valve 120 for expanding the refrigerant; an evaporator 122 for evaporating the refrigerant into gas; and a refrigerant line 124' and 124" for communicating the refrigerant among the aforementioned components. The compressor 112, thermal expansion valve 120, and evaporator 122 may be of conventional design, manufacture, and composition that is typical for such refrigeration system components.

The compressor 112 is mounted within an engine compartment of a motor vehicle (not shown) such that the compressor 112 is powered by an accessory drive belt 126 that connects to a crankshaft pulley of an engine (not shown) or is electrically driven (not shown). Rotation of the engine translates into rotation of the compressor pulley to power the compressor 112 when a clutch 128 on the compressor 112 is engaged. Accordingly, the compressor 112 suctions gaseous refrigerant from an upstream portion of the refrigerant line 124" into an inlet port 130 thereof, compresses the gaseous refrigerant into a high pressure, high temperature superheated gaseous state, and pumps the refrigerant out an outlet 132 downstream toward the IRDC 114. Referring to the pressure vs. enthalpy diagram of FIG. 2, this compression process is represented by path O–A.

Referring again to FIG. 1, the condenser 116 of the IRDC 114 generally includes a pair of opposed header tanks defined by a first header tank 134 and a second header tank 136, and further includes a heat exchanging core 138 fluidically connected between the header tanks 134, 136. The heat exchanging core 138 includes a plurality of horizontal tubes or passages 140 having opposed ends in fluidic communication with the header tanks 134, 136. Corrugated cooling fins 142 are disposed between exterior surfaces 144 of the passages 140 for cooling the refrigerant flowing therethrough. The header tanks 134, 136 are basically vertically disposed hollow vessels having horizontal partitions, dividers, or separators D1–D5 therein. The first header tank 134 includes an inlet port 146 and the opposite, second header tank 136 includes an outlet port 148. It is contemplated, however, that one or the other of the header tanks 134, 136 could include both the inlet port and outlet port 146, 148 depending upon how many and in what location the horizontal partitions D1–D5 are used. Thus far described, the condenser 116 is preferably composed of aluminum, is manufactured in accordance with known condenser manufacturing techniques, and is designed in accord with typical condenser design configurations, with the below-mentioned exceptions.

Preferably, five separators D1, D2, D3, D4, D5 are used to divide the condenser 116 into sub-sections. A condensing stage of the condenser 116 is defined between the inlet port 146 and the fifth separator D5, and a sub-cooling stage is defined between the fifth separator D5 and the outlet port 148. The fourth and fifth separators D4, D5 are disposed at the same elevation within their respective header tanks 136, 134, such that there is no fluidic communication between the condensing and sub-cooling stages within the condenser 116 itself. A person skilled in the art will recognize that the number of separators used is a function of the application and therefore the five separators D1–D5 as disclosed in the preferred embodiment is not intended to be limiting. Any number may be used, or adapted for the application.

Figure 3:
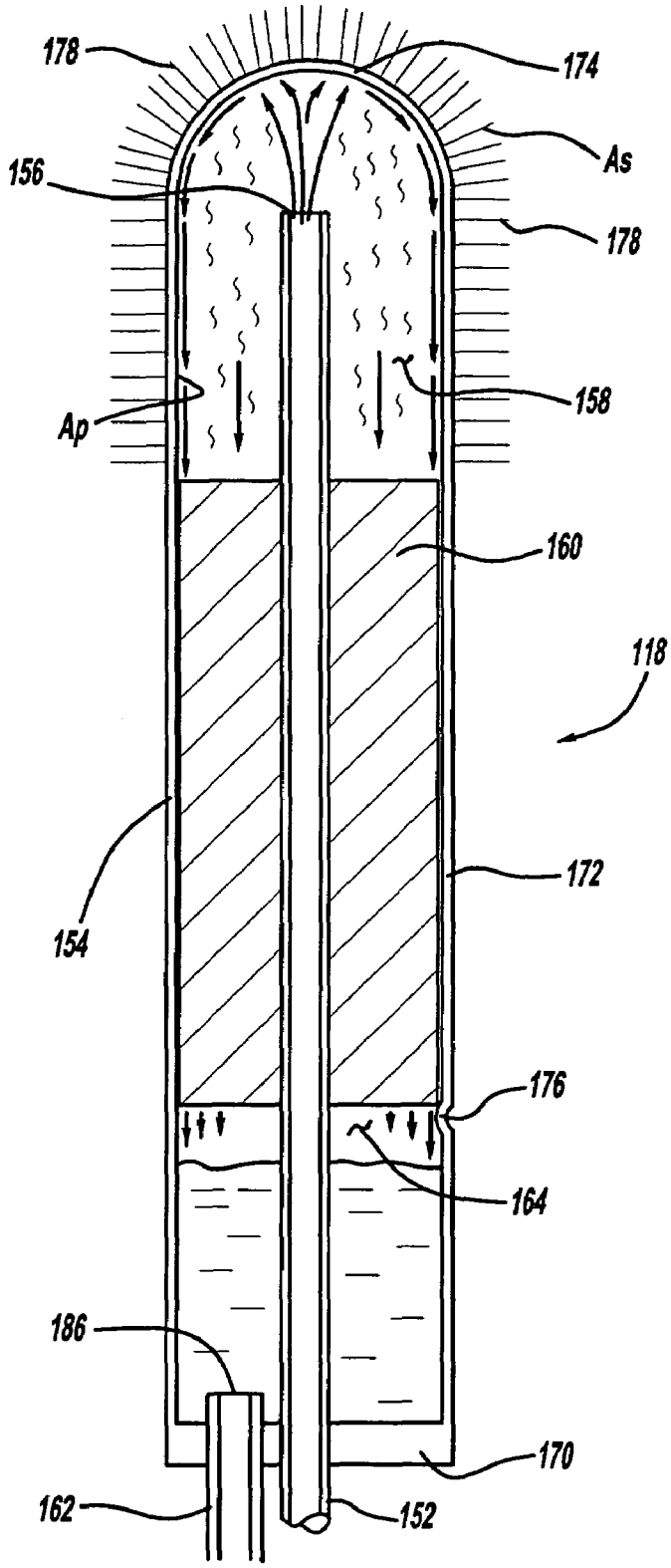
FIG. 3 is a cross-sectional view of the receiver-dryer of FIG. 1.

However, the receiver-dryer 118 of the IRDC 114 fluidically communicates the condensing stage of the condenser 116 to the sub-cooling stage of the condenser 116. The receiver-dryer 118 communicates with an intermediate outlet port 150 at the end of the condensing stage of the condenser 116 via an inlet tube, stand pipe, line 152, or the like, that extends centrally and upwardly within a generally cylindrical housing 154 and terminates in an exit end 156 in an upper portion 158 of the cylindrical housing 154. An integrated filter and adsorbent unit 160 is mounted about the inlet line 152 for dehydrating or removing water from the refrigerant. An outlet line or tube 162 extends downwardly from a lower portion 164 of the cylindrical housing 154 and communicates through an intermediate inlet port 166 with the sub-cooling stage of the condenser 116. The inlet and outlet lines 152, 162 are preferably brazed or joined mechanically to the cylindrical housing 154 and connected to the condenser 116 using tube connecting blocks (not shown), which are known in the art. The receiver-dryer 118 is shown positioned beside the condenser 116, but may be positioned in front thereof to maximize the efficiency of the refrigerant by using cooling fins 175 as shown in FIG. 3. The unique design and construction of the receiver-dryer 118 will be discussed in more detail below with regard to FIGS. 3 and 4.

Figure 2:
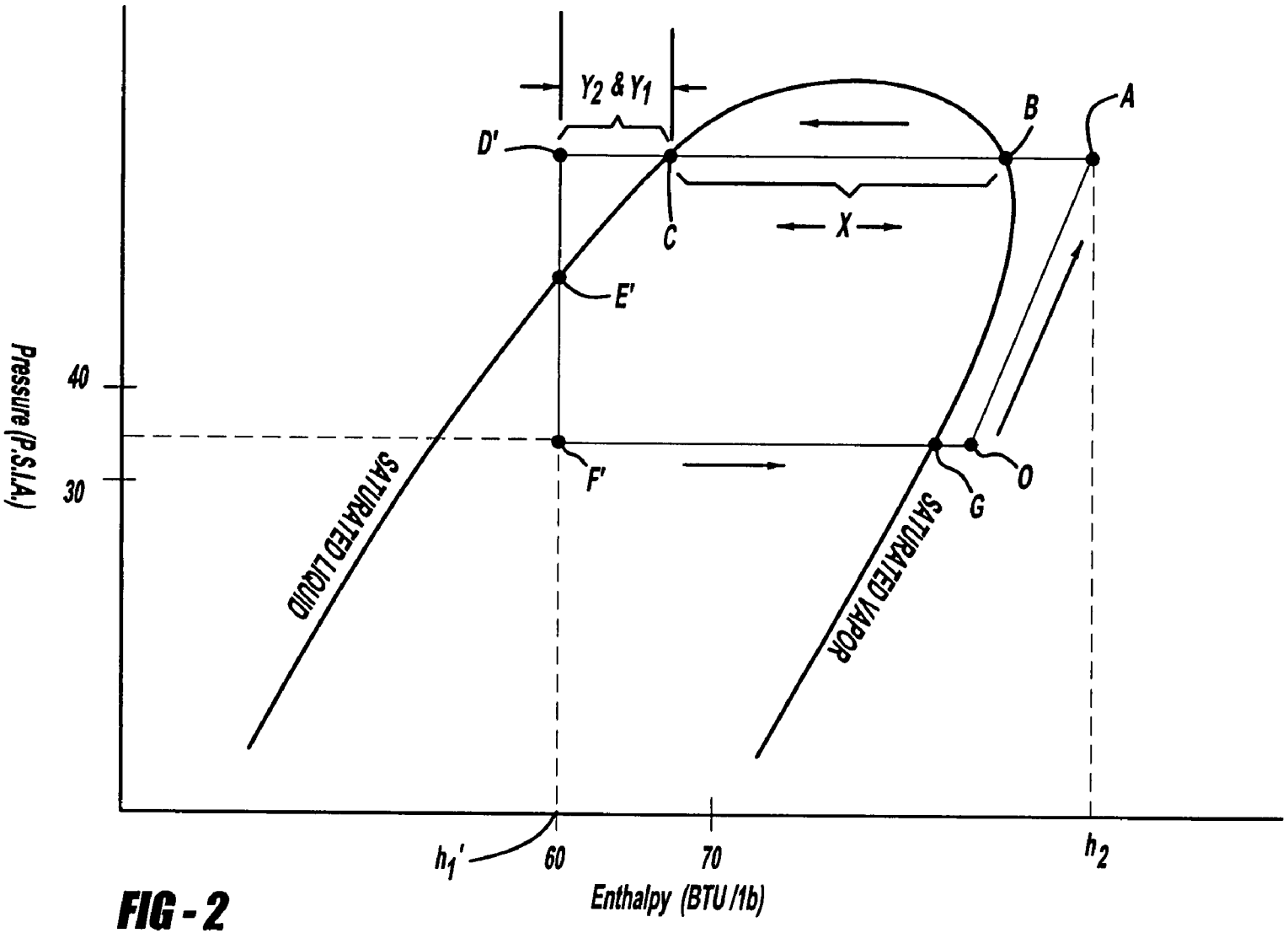
FIG. 2 is a pressure vs. enthalpy diagram illustrating the refrigeration cycle of the refrigeration system of FIG. 1.

The following discussion will refer simultaneously to the apparatus of FIG. 1 and to the graphical depiction of the function of that apparatus in FIG. 2. Referring to FIG. 1, the refrigeration cycle continues within the IRDC 114 to change the pressurized refrigerant fluid from its gaseous phase to a liquid phase, as represented by path A–D' in the pressure vs. enthalpy diagram of FIG. 2. Referring to FIG. 1, the superheated vapor of the refrigerant fluid flows back and forth, winding its way down through the interior of the passages 140 of the condenser 116 while ambient air flows over the cooling fins 142 and exterior surfaces 144 of the passages 140. The superheated vapor is much hotter than the ambient air and, thus, the heat of the superheated vapor is given off to the surrounding ambient air flowing over the cooling fins 142 and other exterior surfaces 144 of the condenser 116, thereby cooling the refrigerant fluid in accord with heat transfer principles. In other words, as the superheated vapor of the refrigerant fluid continues to flow through the condenser 116 and lose more heat to the surrounding ambient air, it begins to condense from its high pressure superheated gaseous phase into a high pressure liquid phase. Point B in the pressure vs. enthalpy diagram of FIG. 2 corresponds to a location in the condenser 116 of FIG. 1 that likely varies between the inlet port 146 and the second separator D2.

Figure 5:
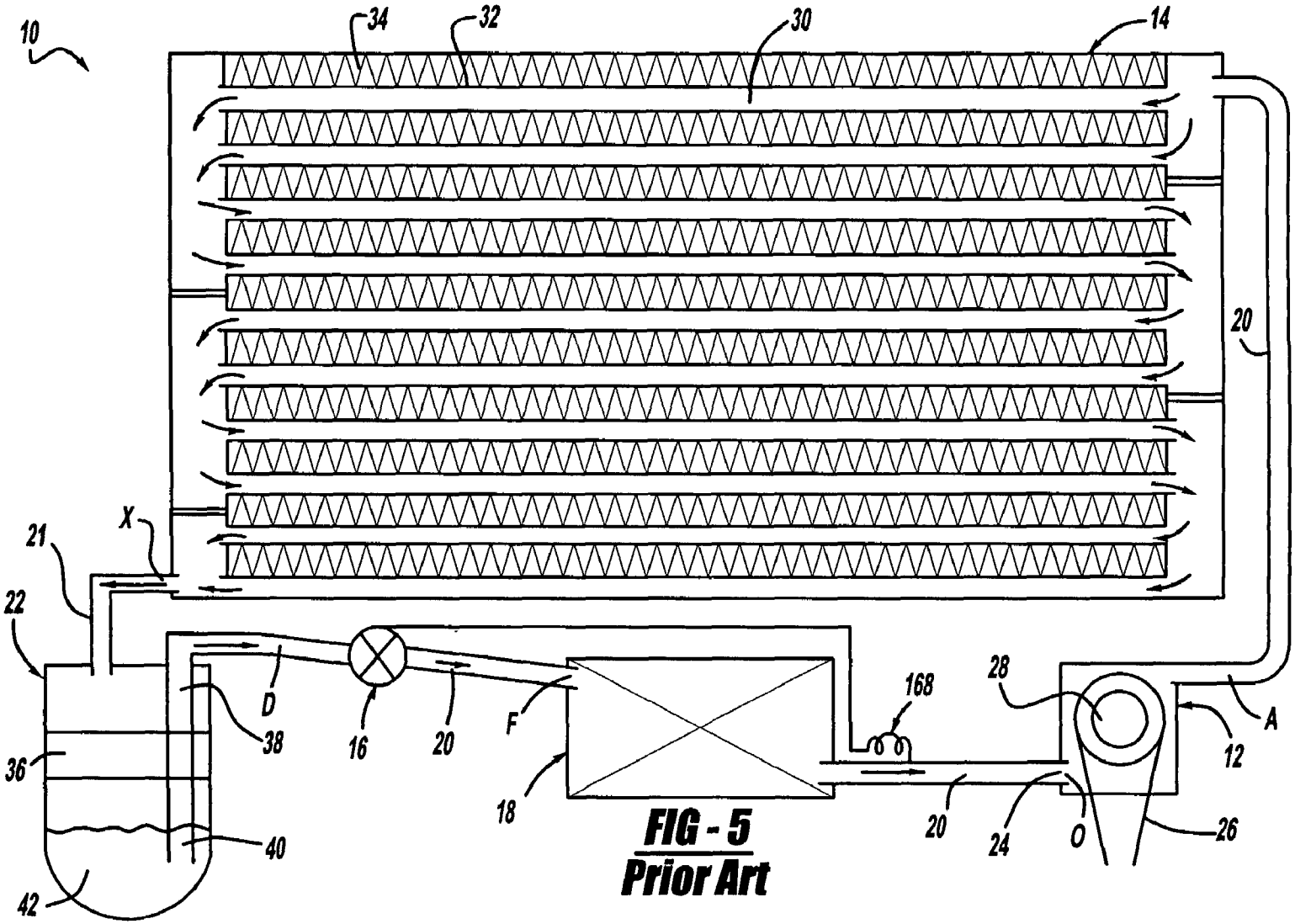
FIG - 5 Prior Art
FIG. 5 is a schematic view of a refrigeration system according to the prior art.
Figure 6:
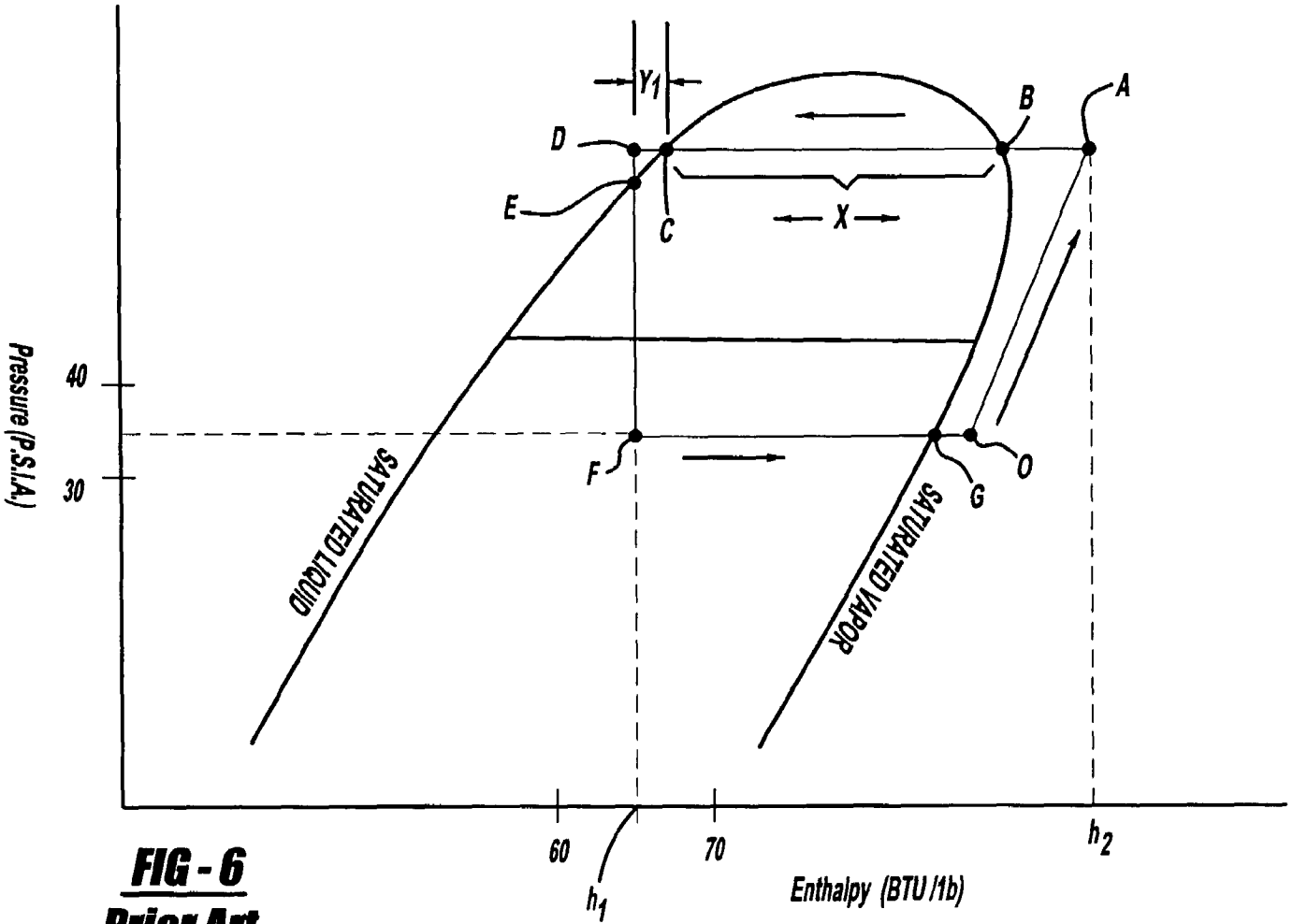
FIG - 6 Prior Art
FIG. 6 is a pressure vs. enthalpy diagram illustrating the refrigeration cycle of the prior art refrigeration system of FIG. 5.

Similar to prior art FIGS. 5 and 6, point X of FIG. 1 corresponds to the variable range X depicted in FIG. 2, wherein the refrigerant exiting the intermediate outlet port 150 is predominantly a liquid phase but also includes some gaseous phase as a result of the cooling capacity. Like the previous discussion with reference to FIG. 6, here range X in FIG. 2 represents the liquid and gaseous phase of the refrigerant fluid at an intermediate portion of the condenser 116 at point X in FIG. 1. Whereas point A in FIG. 2 is well defined and fixed at the location on the pressure vs. enthalpy diagram as shown, any one point within range X is not so well-defined and varies along the condenser path B–C (146 to 150 and from 166–148) of the pressure vs. enthalpy diagram depending upon the vehicle performance variables of vehicle speed and load on the air-conditioning system as illustrated in FIG. 1 from reference character 146 to 150 and 166 to 148'. The slower the vehicle speed and at idle, and the higher the load on the air-conditioning system, any one point within the range X will move in the direction of point B. In other words, as can be seen in FIG. 2, the point within range X can vary from a saturated vapor to a sub-cooled liquid or anywhere in between such as a liquid-vapor mixture. In contrast to the prior art system and diagram of FIGS. 5 and 6, here with the system and diagram of FIGS. 1 and 2 of the present invention, point D' is providing additional amounts of sub-cooling that can be performed within the system $Y_2$.

Rather, point D' is also influenced by the ability of the present invention to provide subsequent efficient sub-cooling and separation of liquid and gas phases of the refrigerant fluid beyond point $X+Y_1$ (between range X and range $Y_1$) and further subsequent sub-cooling beyond range $Y_1$ to range $Y_2$. As shown in FIG. 1, the receiver-dryer 118 is a vertically disposed vessel for separating the refrigerant wherein the mixture of gaseous-liquid phase rises to the top of, and captures the gaseous phase within the upper portion 158 thereof, yet the liquid phase of the refrigerant falls under gravity and settles in the lower portion 164 thereof. Accordingly, location Y in FIG. 1 corresponds to the sub-cooling range $Y_1+Y_2$ depicted in FIG. 2, wherein the refrigerant entering the intermediate inlet port 166 of the condenser 116 is saturated or sub-cooled liquid refrigerant (point C). The refrigerant at location C is mostly saturated liquid refrigerant at location X, because the refrigerant at location X is a varying combination of liquid and gaseous phases whereas the refrigerant at location Y (166) is a stable supply of liquid phase separated in the bottom chamber or outlet line 162 of the lower portion 164 of the receiver dryer 118. Additional sub-cooling takes place within the condenser 116 between the intermediate inlet port 166 and the outlet port 148 whereat the pressurized sub-cooled refrigerant fluid exits the condenser 116 at Point D' as a liquid phase, flows downstream through the refrigerant line 124, and enters the thermal expansion valve 120.

Accordingly, the present invention ensures the presence of sub-cooling and increases the magnitude thereof. This can best be seen by comparing the leftward shift of line D'–F' of FIG. 2 compared to the position of line D–F of prior art FIG. 6. In other words, the present invention increases the enthalpy range from point F' to point O as seen in FIG. 2, compared to the prior art enthalpy range from point F to point O of FIG. 6. The amount of heat (Q) that can be removed by the present invention air-conditioning system is represented by the equation $Q=M_{R134a}*(h2-h1')$. $M_{R134a}$ is the variable mass flow for R134a refrigerant while h2 is the enthalpy at the end of the compression cycle O–A and h1' is the enthalpy at the end of the condensing cycle A–D'. Assuming a constant mass flow, the greater the range in enthalpy that the air-conditioning system can produce, the greater the heat that can be removed. Therefore, by increasing the enthalpy range compared to the prior art, the present invention thereby increases the amount of heat that can be removed from the refrigerant fluid, which translates to an increase in efficiency of the present invention air-conditioning system compared to the prior art.

Continuing through the refrigeration cycle, and referring to FIG. 1, the thermal expansion valve 120 may be any type of adiabatic expansion device that "expands" the condensed high pressure refrigerant liquid so as to suddenly reduce the pressure of the refrigerant liquid to a low pressure liquid and gas phase mist. This sudden reduction in pressure causes the refrigerant fluid to be sprayed through the refrigerant line 124' downstream to the evaporator 122. The opening of the thermal expansion valve 120 is controlled by a thermostat 168 located downstream of the evaporator 122 for maintaining a constant temperature of the refrigerant exiting the evaporator 122. This process is represented in the FIG. 2 pressure vs. enthalpy diagram by path D'–F', wherein point E' represents the point at which the refrigeration cycle crosses the saturated liquid line such that the refrigerant changes from a sub-cooled liquid to a saturated liquid. Point F' represents the liquid/gas phase refrigerant in a fully expanded state ready for evaporation.

Referring again to FIG. 1, the evaporator 122 is positioned downstream of the thermal expansion valve 120 and is preferably located within a passenger compartment of the motor vehicle such as under an instrument panel thereof (not shown). The evaporation process extracts the required latent heat from an incoming stream of fresh or recirculating air by way of a blower (not shown), thereby cooling the air. Within the evaporator 122, the now depressurized liquid phase of the refrigerant fluid changes back into a gaseous phase. While the now relatively cool refrigerant fluid flows through interior passages of the evaporator 122, relatively hot ambient air flows over exterior surfaces of the evaporator 122. The evaporator 122 cools and dehumidifies the hot moist ambient air, because the humidity or water vapor in the hot moist ambient air collects or condenses on the exterior of the evaporator 122. The evaporator 122 also cools the hot moist ambient air because the heat of the hot moist ambient air is given off to the relatively cold refrigerant flowing through the evaporator 122, thereby warming the refrigerant fluid and cooling the air flowing over the exterior surfaces of the evaporator 122. Thus, a supply of cool and dehumidified conditioned air flows away from the evaporator 122 and into the passenger compartment of the motor vehicle, while the evaporated gaseous refrigerant flows out of the interior passages of the evaporator 122, through the refrigerant line 124" downstream back to the compressor 112 where the refrigeration cycle repeats. This process is represented in the FIG. 2 pressure vs. enthalpy diagram by path F'-O, wherein point G represents the point at which the refrigerant changes from a saturated liquid-gas mixture to a saturated gas. The cycle illustrated in FIG. 2, OA to AD' to D'F' to F'O is transient in nature with vehicle speed and ambient heat load.

FIG. 3 illustrates an enlarged view of the receiver-dryer 118 shown in FIG. 1. The cylindrical housing 154 is preferably composed of a thin-walled metal such as a 6063-T6 aluminum alloy, but may be composed of other aluminum, steel, plastic, and the like. The inlet and outlet tubes 152, 162 are preferably brazed to the cylindrical housing 154 and are preferably composed of a 3003-H14 aluminum alloy, but may be composed of other aluminum, steel, plastic, and the like. The receiver-dryer 118 of FIG. 1 is a substantially cylindrical vessel, container, or housing having a base wall 170, a side wall 172 extending vertically upwardly from the base wall 170, and a concave end 174 terminating the side wall 172. The concave end 174 need not, but may, take the form of a thin-walled spherical wall, just as long as a concave interior surface is defined by the concave end 174. The walls 170, 172, 174 collectively define an interior of the cylindrical housing 154. The refrigerant inlet pipe 152 extends into the interior of the cylindrical housing 154 and terminates in the exit end 156 facing the concave interior surface of the concave wall 174 of the cylindrical housing 154. The receiver-dryer 118 also includes the integrated filter and adsorbent unit 160 that is centrally disposed over the inlet tube 152 and that is elevated by one or more indentations 176 formed into the side wall 172 of the cylindrical housing 154. The adsorbent unit 160 may be a saddle bag type device, a puck-like device, or any other suitable desiccant and filter device that is known. The adsorbent unit 160 effectively divides the interior of the cylindrical housing 154 into the upper portion 158 above the adsorbent unit 160 and the lower portion 164 below the adsorbent unit 160.

Figure 4:
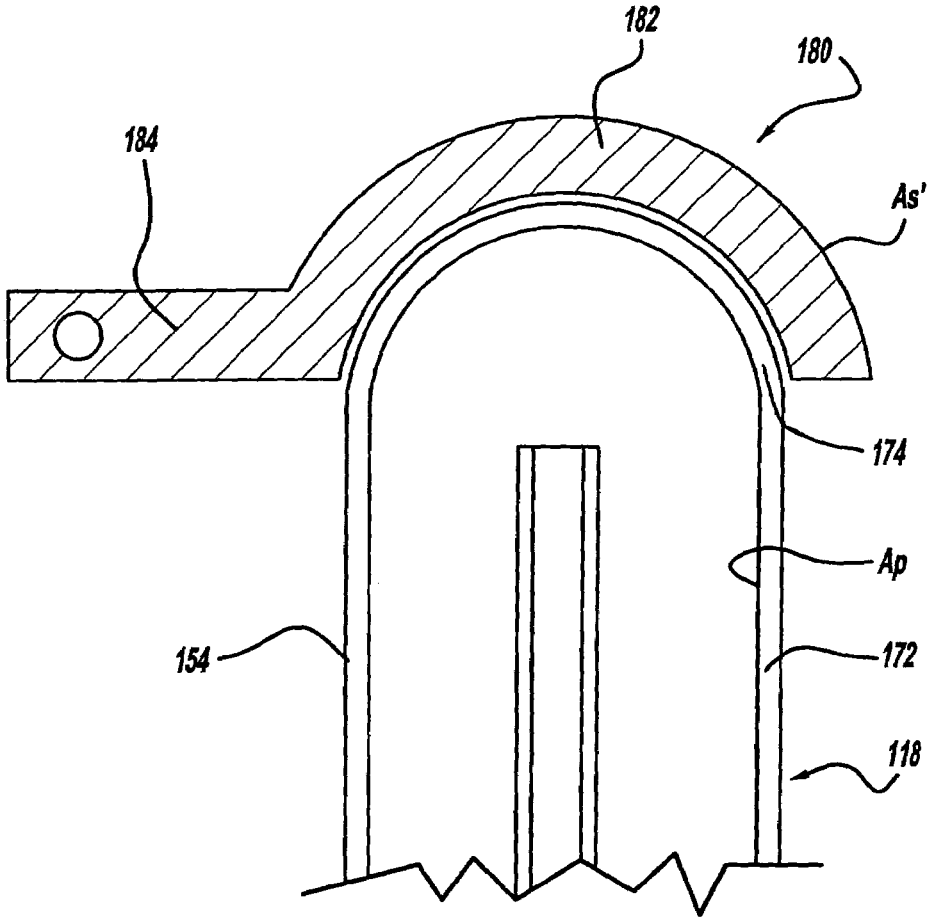
FIG. 4 is a cross-sectional view of a receiver-dryer according to an alternative embodiment of the present invention.

The inlet tube 152 is adapted for directing the refrigerant fluid into contact with the concave end wall 174 such that the refrigerant fluid impinges on the inner concave end wall 174 to separate the mixture of liquid/gaseous refrigerant fluid into a gaseous phase that accumulates in the upper portion 158 of the cylindrical housing 154 and a liquid phase that by adhering to the interior concave end wall 174 falls under gravity to accumulate in the lower portion 164 of the cylindrical housing 154. The design of the concave wall 174 and proximity of the exit end 156 of the inlet tube 152 is adapted for substantial contact of liquid refrigerant and relatively uniform dispersion of refrigerant so that a substantial amount of refrigerant liquid adheres to the inner surfaces of the cylindrical housing 154 due to liquid surface tension and wherein the liquid runs down interior surfaces of the concave wall 174 and side wall 172 for heat transfer cooling therewith. Additional efficiency maybe obtained by the use of cooling fins 178 as shown in FIG. 3. Therefore, cooling fins 178 are preferably disposed on the exterior of the cylindrical housing 154 for increased heat transfer cooling of the refrigerant fluid. The combined secondary surface area of the cooling fins 178 is represented by element $A_s$ and the combined primary surface area of the concave wall 174 and side wall 172 in the upper portion 158 of the cylindrical housing 154 is represented by element $A_p$. According to the present invention, $A_s$ is preferably greater than $A_p$. The unique design of the concave wall 174 and proximity of the inlet tube 152 with respect thereto enables relatively greater dispersion of the refrigerant fluid, and the cooling fins 178 enable relatively greater conversion of the refrigerant fluid into a liquid phase. Both features provide for greater condensing of the refrigerant gas phase into liquid phase. The cooling fins 178 may be separately attached to the cylindrical housing 154 such as by brazing, or may be assembled thereto as a separate sub-assembly. In a similar vein, FIG. 4 illustrates an alternative embodiment of the present invention, in which the heat transfer functionality of the cooling fins 178 (shown in FIG. 3) is substituted by an isomount hat 180 or maybe integrated with the cooling fins 178 (shown in FIG. 3).

The isomount hat 180 includes a socket shaped portion 182 that is adapted for heat transfer contact with the top of the cylindrical housing 154 and further includes a bracket portion 184 that is adapted for fastening to another structural member such as the condenser 116 or any other proximate structure within an engine compartment. Accordingly, the top of the receiver-dryer 118 may be firmly supported and mounted within the engine compartment for less vertical and lateral movement of the receiver-dryer 118. The socket shaped portion 182 is concave shaped for conforming contact with the convex shaped concave wall 174 of the cylindrical housing 154. The socket shaped portion 182 is also preferably constructed of a relatively high thermally conductive material such as aluminum or steel and may have a metallic or non-metallic outer skin. It is contemplated that the isomount hat 180 could be used in combination with the cooling fin 178 arrangement of FIG. 3. In any case, a secondary surface area As' should be greater than the primary surface area Ap.

Referring again to FIG. 3, the outlet line 162 has an entrance end 186 in fluidic communication with the lower portion 164 of the cylindrical housing 154 for permitting only the liquid phase of the refrigerant and a lubricant to exit the receiver-dryer 118. The level of saturated liquid and lubricant will change depending upon the condensing capacity of the apparatus, the cooling load placed on the refrigeration system, vehicle performance, and the like.

The receiver-dryer 118 may be manufactured according to any of the well-known techniques for forming aluminum canisters, but is preferably constructed by the following described process. The cylindrical housing 154 preferably originates from tube stock which is impact closed to form the flat bottom end or base wall 170. However, the cylindrical housing 154 may originate from sheet or tubular stock, which is then deep drawn to form the base wall 170. Holes are then drilled in the closed bottom end or base wall 170 and the inlet and outlet tubes 152, 162 are inserted therein and brazed to the cylindrical housing 154. The inlet tube 152 is inserted within the cylindrical housing 154 such that the exit end 156 thereof faces the top inside surface of the concave wall 174 after formation thereof and is disposed within a distance that is substantially proximate the radius of the spherical-shaped concave wall 174 of the cylindrical housing 154. Alternatively, the exit end 156 may be spaced from the top inside surface within proximity of the radius dimension of the spherical concave wall 174. Then, the indentation(s) 176 are formed in the side wall 172 of the cylindrical housing 154 by tri-crimping or forming cylindrically the cylindrical housing 154, or the like. Next, the integrated filter and adsorbent unit 160 is assembled into the interior of the cylindrical housing 154. The open end of the tube stock is spun closed to form the closed top end or concave interior wall 174. Spin closing of aluminum containers is generally known in the art, e.g. by U.S. Pat. No. 5,245,842, which is incorporated by reference herein. Uniquely, however, the top end or concave wall 174 is preferably spun closed in such a manner so as to achieve a concave, rounded, and preferably spherical, top inside surface of the concave wall 174.

In accordance with the present invention, the preferred method involves improved sub-cooling of the refrigerant within an air conditioning system. The method may be practiced in accord with the refrigeration system 110 of FIG. 1, but may also be practiced using any suitable air conditioning system. The method includes receiving a superheated gaseous phase of a refrigerant fluid in a condensing stage of a condenser, and condensing the superheated gaseous phase of the refrigerant fluid within the condensing stage into a mixture of a gaseous phase and a liquid phase of refrigerant. The method further involves communicating the mixture into a vertically disposed container, housing, or vessel, and directing the mixture into a top concave surface of the vertically disposed container, thereby dispersing the liquid phase from the gaseous phase wherein the liquid phase falls toward a lower portion of the container over a desiccant material, and further thereby cooling the gas and liquid phases for improved sub-cooling of the liquid phase by adhering to the interior concave wall 174 and for improved condensing of the gas phase into the liquid phase. Accordingly, the method produces a separated, cooled, and dehydrated liquid phase that accumulates in the lower portion of the container. Finally, the method includes communicating the separated, cooled, and dehydrated liquid phase out of the container and back into a sub-cooling stage of the condenser.

With each of the embodiments described above, a condenser stage of a refrigeration cycle is optimized for greater dispersion and increased cooling of refrigerant to condense a relatively greater amount of gaseous phase refrigerant into liquid phase refrigerant. The present invention thereby provides for increased sub-cooling of the refrigerant for cooler air output in a passenger compartment of an automobile per a given work input of a compressor, thereby increasing the efficiency of the air conditioning system.

While the present invention has been described in terms of a preferred embodiment, it is apparent that other forms could be adopted by one skilled in the art. In other words, the teachings of the present invention encompass any reasonable substitutions or equivalents of claim limitations. For example, the structure, materials, sizes, and shapes of the individual components could be modified, or substituted with other similar structure, materials, sizes, and shapes. Specific examples include providing slight alterations to the shape of the concave end of the receiver-dryer vessel that achieve similar beneficial results as the present invention. Those skilled in the art will appreciate that other applications, including those outside of the automotive industry, are possible with this invention. Accordingly, the present invention is not limited to only automotive refrigeration systems. Accordingly, the scope of the present invention is to be limited only by the following claims.

What is claimed is:

1. A receiver-dryer comprising:

a substantially cylindrical vessel having a base wall; a side wall having an outer surface, said side wall extending generally in a direction away from said base wall; and a concave end wall having an outer surface, said concave end wall terminating said side wall and disposed substantially opposite of said base wall to define an interior chamber, said interior chamber having an upper portion and a lower portion;

a refrigerant inlet pipe mounted to said base wall extending into said interior chamber of said vessel, said refrigerant inlet pipe extending in a direction generally away from said base wall within said interior chamber of said vessel and terminating in an exit end facing said concave end wall, said refrigerant inlet pipe adapted for directing refrigerant into contact with said concave end wall such that said refrigerant impinges on said concave end wall to disperse said refrigerant into a gaseous phase that accumulates in said upper portion of said interior chamber and a liquid phase that drains down said concave end wall and said side wall for heat transfer cooling and for accumulation in said lower portion of said interior chamber; and means for cooling said concave end wall, said cooling means being mounted complementary to said outer surface of said concave end wall such that said liquid refrigerant that drains down said concave end wall is cooled by said means for cooling.

2. The receiver-dryer as claimed in claim 1, further comprising cooling fins in intimate contact with said outer surface of said side wall of said vessel.

3. The receiver-dryer as claimed in claim 2, wherein the combined surface area of said cooling fins is greater than the surface area of the interior surface of said vessel within said upper portion of said vessel.

4. The receiver-dryer as claimed in claim 1, further comprising a mounting bracket having a socket portion mounted complementary to said concave end wall of said vessel.

5. The receiver-dryer as claimed in claim 4, wherein the surface area of said socket portion of said mounting bracket is greater than the surface area of the interior surface of said vessel within said upper portion of said vessel.

6. The receiver-dryer as claimed in claim 1 wherein said refrigerant inlet pipe is centrally disposed within said vessel.

7. The receiver-dryer as claimed in claim 1 wherein said exit end of said refrigerant inlet pipe is positioned a predetermined distance away from said concave end wall, said predetermined distance being proximate the radius of said concave end wall.

8. The receiver-dryer as claimed in claim 1, wherein said concave end wall is spun closed and substantially spherical in shape.

9. An integrated receiver-dryer-condenser for use in an air conditioning system, said integrated receiver-dryer-condenser comprising:

a condenser having:

a first vertically disposed header tank;

a second vertically disposed header tank spaced opposite said first vertically disposed header tank;

a core member positioned between said first and second vertically disposed header tanks, said core member having a plurality of horizontally disposed passages in fluidic communication with said first and second vertically disposed header tanks for communicating refrigerant fluid therebetween;

an inlet in one of said first and second vertically disposed header tanks, said inlet adapted for receiving a superheated gaseous phase of said refrigerant fluid;

an intermediate outlet port in one of said first and second vertically disposed header tanks, said intermediate port adapted for exiting a mixture of a gaseous phase and a liquid phase of said refrigerant fluid;

an intermediate inlet port in one of said first and second vertically disposed header tanks, said intermediate inlet port adapted for receiving a dispersed liquid phase of said refrigerant fluid;

an outlet in one of first and second vertically disposed header tanks, said outlet adapted for exiting a sub-cooled liquid phase of said refrigerant fluid; and a receiver-dryer in fluidic communication with said condenser, said receiver-dryer having:

a substantially cylindrical vessel having a base wall; a side wall having an outer surface extending generally in a direction away from said base wall; and a concave end wall having an outer surface, said concave end wall terminating said side wall and disposed substantially opposite of said base wall to define an internal chamber having an upper portion and a lower portion;

a refrigerant inlet pipe in fluidic communication with said intermediate outlet port of one of said first and second vertically disposed header tanks, said refrigerant inlet pipe extending into said internal chamber, said refrigerant inlet pipe extending in a direction away from said base wall within said internal chamber of said vessel and terminating in an exit end facing said concave end wall, said refrigerant inlet pipe adapted for directing refrigerant into contact with said concave end wall such that said refrigerant impinges on said concave end wall to disperse said refrigerant into a gaseous phase that accumulates in said upper portion of said internal chamber of said vessel and a liquid phase that runs down the interior surfaces of said concave end wall and said side wall toward said base wall for heat transfer cooling and for accumulating said liquid phase of said refrigerant in said lower portion of said internal chamber;

a refrigerant outlet pipe in fluidic communication with said refrigerant liquid in said lower portion of said vessel and with said intermediate inlet port in one of said first and second vertically disposed header tanks of said condenser; and means for cooling said concave end wall, said cooling means being mounted complementary to said outer surface of said concave end wall such that said liquid refrigerant that drains down said concave end wall is cooled by said means for cooling.

10. The integrated receiver-dryer-condenser as claimed in claim 9, further comprising cooling fins in intimate contact with said outer surface of said side wall of said vessel.

11. The integrated receiver-dryer-condenser as claimed in claim 9, wherein the combined surface area of said cooling fins is greater than the surface area of the interior surface of said vessel within said upper portion of said vessel.

12. The integrated receiver-dryer-condenser as claimed in claim 9, further comprising a mounting bracket having a socket portion mounted complementary to said concave end wall of said vessel.

13. The integrated receiver-dryer-condenser as claimed in claim 12, wherein the surface area of said socket portion of said mounting bracket is greater than the surface area of the interior surface of said vessel within said upper portion of said vessel.

14. The integrated receiver-dryer-condenser as claimed in claim 9 wherein said refrigerant inlet pipe is centrally disposed within said vessel.

15. The integrated receiver-dryer-condenser as claimed in claim 9 wherein said exit end of said refrigerant inlet pipe is positioned a predetermined distance away from said concave end wall, said predetermined distance being substantially equal to the radius of said concave end wall.

16. The integrated receiver-dryer-condenser as claimed in claim 9, wherein said concave end wall is spun closed and substantially spherical in shape.

17. A method of sub-cooling a refrigerant within an air conditioning system, said method comprising the steps of:

receiving a superheated gaseous phase of a refrigerant fluid in a condensing stage of a condenser;

condensing said superheated gaseous phase of said refrigerant fluid within a first condensing stage of said condenser into a mixture of a gaseous phase and a liquid phase;

communicating said mixture into an internal chamber of a vessel;

dispersing said mixture against a concave surface of said vessel, thereby separating said liquid phase from said gaseous phase wherein said liquid phase adheres to the walls of said internal chamber of said vessel and flows along said walls toward a lower portion of said vessel through a desiccant material, and accumulates in the bottom thereof thereby cooling said gas and liquid phases for improved separation of said liquid phase from said gaseous phase of said mixture; and communicating said liquid phase of said refrigerant out of said vessel into a separate second stage of said condenser for improved sub-cooling of said liquid phase of said refrigerant fluid.

18. An air conditioning system comprising:

means for receiving a superheated gaseous phase of a refrigerant fluid in a condensing stage of a condenser;

means for condensing said superheated gaseous phase of said refrigerant fluid within a first stage of said condenser into a mixture of a gaseous phase and a liquid phase;

means for communicating said mixture into a vessel;

means for dispersing said mixture onto a concave surface of said vessel, thereby separating said liquid phase from said gaseous phase of said mixture wherein said liquid phase flows toward a lower portion of said vessel over a desiccant material, and further thereby cooling said gas and liquid phases for improved separation of said liquid phase from said gaseous phase into said liquid phase; and means for communicating said liquid phase out of said vessel and into a separate second stage of said condenser from improved sub-cooling of said liquid phase of said refrigerant fluid.

* * * * *

UNITED STATES PATENT AND TRADEMARK OFFICE

CERTIFICATE OF CORRECTION

PATENT NO. : 7,093,461 B2
APPLICATION NO. : 10/801889
DATED : August 22, 2006
INVENTOR(S) : Chhotu N. Patel and Paul Matthews Pickett, Jr.

It is certified that error appears in the above-identified patent and that said Letters Patent is hereby corrected as shown below:

In column 3, Line 17, Kindly delete “condenser, 14” and insert --condenser 14,--.

In Column 6, Line 20, Kindly delete “1a” and insert --1 a--.

In Column 7, Line 43, Kindly delete “175” and insert --178--.

In Column 8, Line 20, Kindly delete “148'.” and insert --148.--.

In Column 8, Line 50, Kindly delete “receiver dryer” and insert --receiver-dryer--.

In Column 14, Line 47, Claim 14, Kindly delete “9” and insert --9,--.

In Column 14, Line 50, Claim 15, Kindly delete “9” and insert --9,--.

In Column 16, Line 14, Claim 18, Kindly delete “from” and insert --for--.

Signed and Sealed this

Twentieth Day of February, 2007

JON W. DUDAS
*Director of the United States Patent and Trademark Office*